US006042218A

United States Patent [19]

Nakahara

[11] Patent Number: 6,042,218

[45] Date of Patent: Mar. 28, 2000

[54] INK JET PRINTER

[75] Inventor: Junji Nakahara, Nagoya, Japan

[73] Assignee: Brother Kogyo Kabushiki Kaisha, Nagoya, Japan

[21] Appl. No.: 08/995,515

[22] Filed: Dec. 22, 1997

[30] Foreign Application Priority Data

Mar. 19, 1997 [JP] Japan ..... 9-085683

[51] Int. Cl.[7] ..... B41J 2/165

[52] U.S. Cl. ..... 347/35

[58] Field of Search ..... 347/35, 22, 23

[56] References Cited

U.S. PATENT DOCUMENTS 5,850,236 12/1998 Murai et al. ..... 347/35

*Primary Examiner*—Huan Tran
*Attorney, Agent, or Firm*—Oliff & Berridge, PLC

[57] ABSTRACT

An ink jet printer has a printing head that ejects ink supplied from an ink source, from a nozzle to a recording medium, and a preliminary ejection unit that performs preliminary ink ejection from the nozzle to a waste ink receiving portion provided at a predetermined position, to achieve a good ink ejecting condition of the printing head. A timer measures elapsed time including time between an operation of preliminary ink ejection to the waste ink receiving portion and output of a printing instruction. A controller variably controls the amount of the ink to be preliminarily ejected to the waste ink receiving portion, corresponding to the length of the elapsed time measured by the timer. If a plurality of heads that eject different inks are provided, the amount of ink to be preliminarily ejected is varied corresponding to the elapsed time and properties of the inks.

20 Claims, 4 Drawing Sheets

Fig.3

90

| TIME AFTER PREVIOUS FLUSHING | BK | Y, M, C |
|---|---|---|
| SHORTER THAN 10 SECS. | 0 | 0 |
| 10 SECS. OR LONGER BUT LESS THAN 30 M | 10 | 0 |
| 30 M OR LONGER BUT LESS THAN 1 H | 20 | 10 |
| 1 H OR LONGER BUT LESS THAN 3 H | 30 | 20 |
| 3 H OR LONGER BUT LESS THAN 6 H | 60 | 60 |
| 6 H OR LONGER BUT LESS THAN 12 H | 120 | 120 |
| 12 H OR LONGER BUT LESS THAN 24 H | 250 | 250 |
| 24 H OR LONGER | 500 | 500 |

INK JET PRINTER

BACKGROUND OF THE INVENTION

1. Field of Invention

The present invention relates to an ink jet printer that ejects ink droplets to a recording medium and, more particularly, to an ink jet printer able to prevent the nozzles of a print head from drying by preliminarily ejecting ink from the nozzles before printing.

2. Description of Related Art

A conventional ink jet printer performs a maintenance operation termed flushing to recover the ink ejecting function of a print head whose nozzles have dried, by periodically moving the print head, prior to printing, to a position where a waste ink receiving portion is provided, and ejecting ink from all the nozzles of the print head to the waste ink receiving portion a predetermined number of times.

In the above-described ink jet printer, however, flushing is performed at regular intervals of time by ejecting ink a predetermined number of times, regardless of the length of time between previous flushing and a start of printing. Since flushing is performed by ejecting a predetermined number of times (for example, 500 times) even if the time elapsing between previous flushing and a start of printing is short so that the nozzles are still wet, the ink jet printer conventional printer has a drawback of a unnecessary consumption of ink.

SUMMARY OF THE INVENTION

Accordingly, it is an object of the present invention to provide an ink jet printer able to perform flushing with a reduction in unnecessary consumption of ink.

According to the present invention, there is provided an ink jet printer including a printing head unit that ejects ink supplied from an ink source, from a nozzle to a recording medium, and a preliminary ejection unit that performs preliminary ink ejection from the nozzle to a waste ink receiving portion provided at a predetermined position, to achieve a desirable ink ejecting condition of the printing head unit. A timer is provided for measuring an elapsed time including a time between an operation of preliminary ink ejection to the waste ink receiving portion and output of a printing instruction to the printing head unit. A controller is provided for variably controlling an amount of the ink to be preliminarily ejected to the waste ink receiving portion, corresponding to a length of the elapsed time measured by the timer.

The amount of ink to be preliminarily ejected to the waste ink receiving portion is variably controlled corresponding to an elapsed time including a time between the previous preliminary ink ejection from the print head unit and output of a printing instruction to the printing head unit, during which time no ink ejection is performed. For example, if the elapsed time during which no ink ejection is performed is relatively short, the ink jet printer of the invention preliminarily ejects a smaller amount of ink than an amount of ink to be preliminarily ejected if the elapsed time is relatively long. Therefore, unnecessary ink consumption is reduced.

The printing head unit may include a plurality of heads that eject inks having different properties. In such a case, the timer measures elapsed time including time between an operation of preliminary ink ejection from each of sets of the individual heads to the waste ink receiving portion, and output of a printing instruction, and the controller variably controls, separately for each set of printing heads, the amount of the ink to be preliminarily ejected, corresponding to the length of the elapsed time measured by the timer and a property of an ink ejected by each set of printing heads. A set of printing heads could include one or more printing heads.

Since the drying speed of ink varies depending on properties of inks, the amount of ink to be ejected from each set of printing heads is variably controlled corresponding to properties of the inks as well as the length of time during which no ink ejection is performed. Therefore, unnecessary ink consumption is further reduced.

The controller may determine equal amounts of the inks to be preliminarily ejected from each of the sets of the plurality of heads if the elapsed time measured by the timer is longer than a predetermined length of time.

The timer may remain in operation even if a power switch of the ink jet printer is turned off, so as to continue measuring time elapsing after a previous operation of preliminary ink ejection. The inclusion of a portable power source for the timer enables shutting off of the printer power switch, or even disconnection of the printer from a power source.

The amount of ink to be preliminarily ejected may be determined in terms of the number of times to eject the ink.

BRIEF DESCRIPTION OF THE DRAWINGS

A preferred embodiment of the present invention will be described in detail with reference to the following figures wherein:

FIG. 3 illustrates the structure of a flushing table stored in a ROM shown in FIG. 2.

DETAILED DESCRIPTION OF PREFERRED EMBODIMENTS

A preferred embodiment of the present invention will be described in detail hereinafter with reference to the accompanying drawings.

Figure 1:
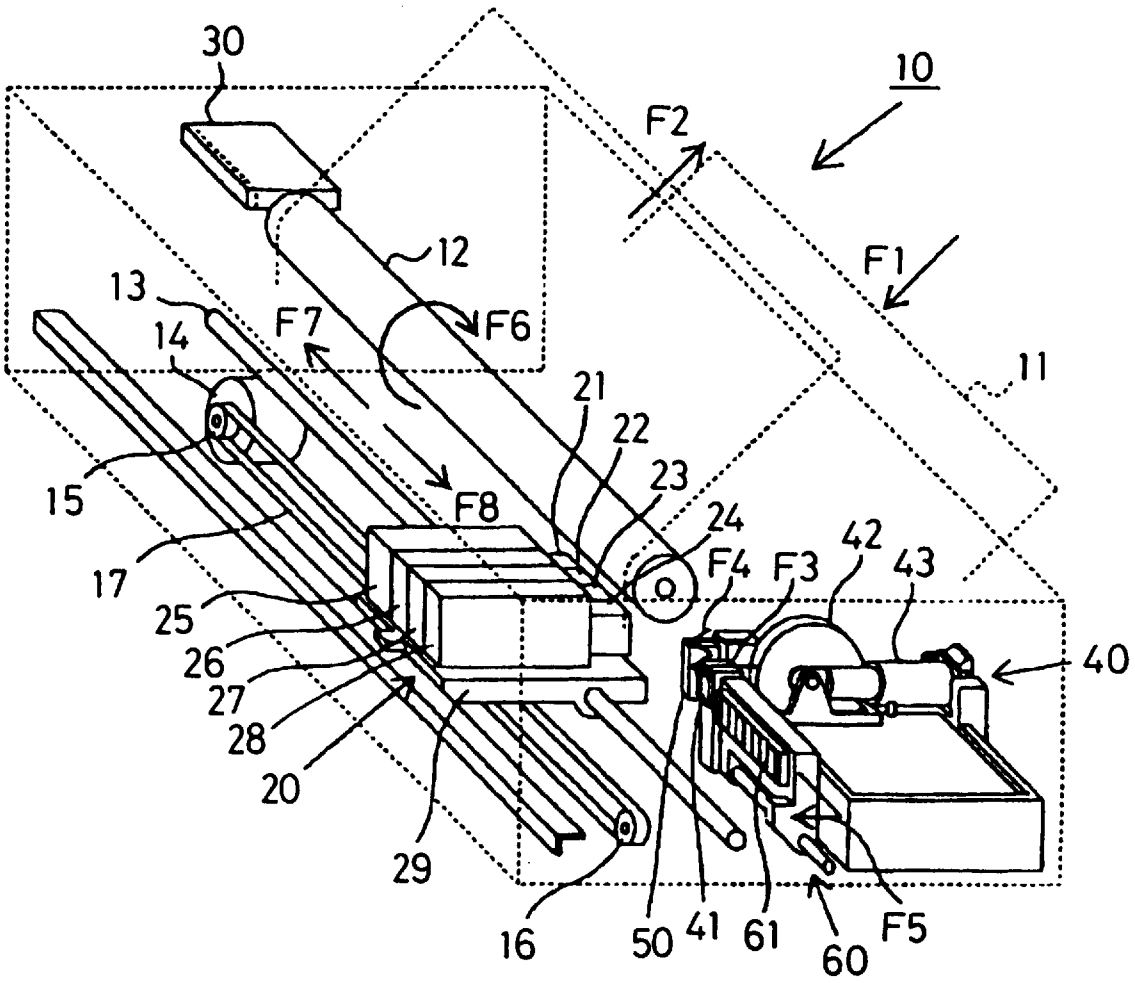
FIG. 1 illustrates portions of the interior construction of an embodiment of the ink jet printer of the present invention.

FIG. 1 illustrates portions of the interior construction of an embodiment of the ink jet printer of the present invention. This embodiment will be described with reference to an ink jet printer (hereinafter, referred to as "printer") that uses a piezoelectric effect by a piezoelectric element.

A printer 10 has a platen roller 12 that conveys a print sheet 11, that is, a recording medium, fed thereto in a direction indicated by an arrow F1 in FIG. 1, out in a direction indicated by an arrow F2. Disposed below the platen roller 12 is a carriage shaft 13 extending parallel to the axis of the platen roller 12. The carriage shaft 13 supports a carriage 29 on which a recording head unit 20 is mounted. A carriage motor 14 is disposed leftward below the carriage shaft 13, and a pulley 16 is disposed rightward below the carriage shaft 13. A rotating shaft of the carriage motor 14 is connected to a pulley 15. The pulleys 15, 16 are interconnected by an endless belt 17.

The carriage 29 is connected to the belt 17 so that the carriage 29 is moved along the carriage shaft 13 in directions indicated by arrows F7, F8 by the carriage motor 14.

The print head unit 20 has a black ink head 21 for ejecting a black ink, a yellow ink head 22 for ejecting a yellow ink, a cyan ink head 23 for ejecting a cyan ink, and a magenta ink head 24 for ejecting a magenta ink. The ink heads 21–24 are provided with ink cartridges 25–28, respectively, which are ink sources.

Each head 21–24 has a plurality of ink chambers (not shown) that receive ink from the corresponding ink cartridge 25–28. A nozzle (not shown) for ejecting ink from the corresponding ink chamber is formed on a surface of the ink chamber facing the platen roller 12. A portion of the walls of each ink chamber is formed by a piezoelectric element. When a drive voltage is applied to a piezoelectric element, the capacity of the corresponding ink chamber changes and, due to a capacity change, ink is ejected from the ink chamber through the nozzle. Printing on a print sheet 11 is thereby performed.

An ink absorbing pad 30 made of a porous material is disposed at a predetermined location at a left side of the platen roller 12, which location is outside the printing area on the print sheet 11. The ink absorbing pad 30 forms a waste ink receiving portion for absorbing ink that is ejected from the heads 21–24 during the flushing of the heads 21–24, that is, during preliminary ink ejection. Flushing is performed before printing and between printing operations of the print head unit 20. The flushing operation prevents the nozzles of the heads 21–24 from becoming dry and, therefore, prevents ink ejection failure caused by dry ink.

A purge device 40, that is, an ink suction device for recovery of the heads 21–24 from ink ejection failure or impeded ink ejection, is disposed at a location at a right side of the platen roller 12, which location is outside the printing area. The purge device 40 has a suction cap 41 that sequentially covers the nozzle-formed surfaces of the heads 21–24. When the print head unit 20 reaches a purging position, the suction cap 41 is moved in a direction indicated by an arrow F3 to sequentially cover the nozzle-formed surfaces of the heads 21–24. A pump 43 is subsequently driven by rotation of a cam 42 to produce a negative pressure whereby ink is drawn together with air bubbles and the like, out of the ink chambers through the nozzles. Thereby, the ejection function of the individual heads is sequentially recovered.

A wiper member 50 is provided at a left side of the suction cap 41, for wiping ink, dust particles or the like from the nozzle-formed surface of each head 21–24 after the purging thereof. The wiper member 50 is moved in a direction indicated by an arrow F4 in FIG. 1 at a timing at which the purging of a head is completed, so that the wiper member 50 wipes the nozzle-formed surface of the head, which moves toward the printing area. In this manner, the wiper member 50 removes ink or the like from the nozzle-formed surface, thereby preventing staining of a print surface of the print sheet 11 with residual ink on a nozzle-formed surface.

A capping device 60 is disposed at a right side of the suction cap 41, for placing a cap 61 on the nozzle-formed surfaces of the heads 21–24 of the print head unit 20 at a home position. When the print head unit 20 returns to the home position, the cap 61 is moved in a direction indicated by an arrow F5 in FIG. 1 to cover the nozzle-formed surfaces of the heads 21-24, thereby preventing the inks in the heads 21–24 from drying while the printer 10 is not in use.

Figure 2:
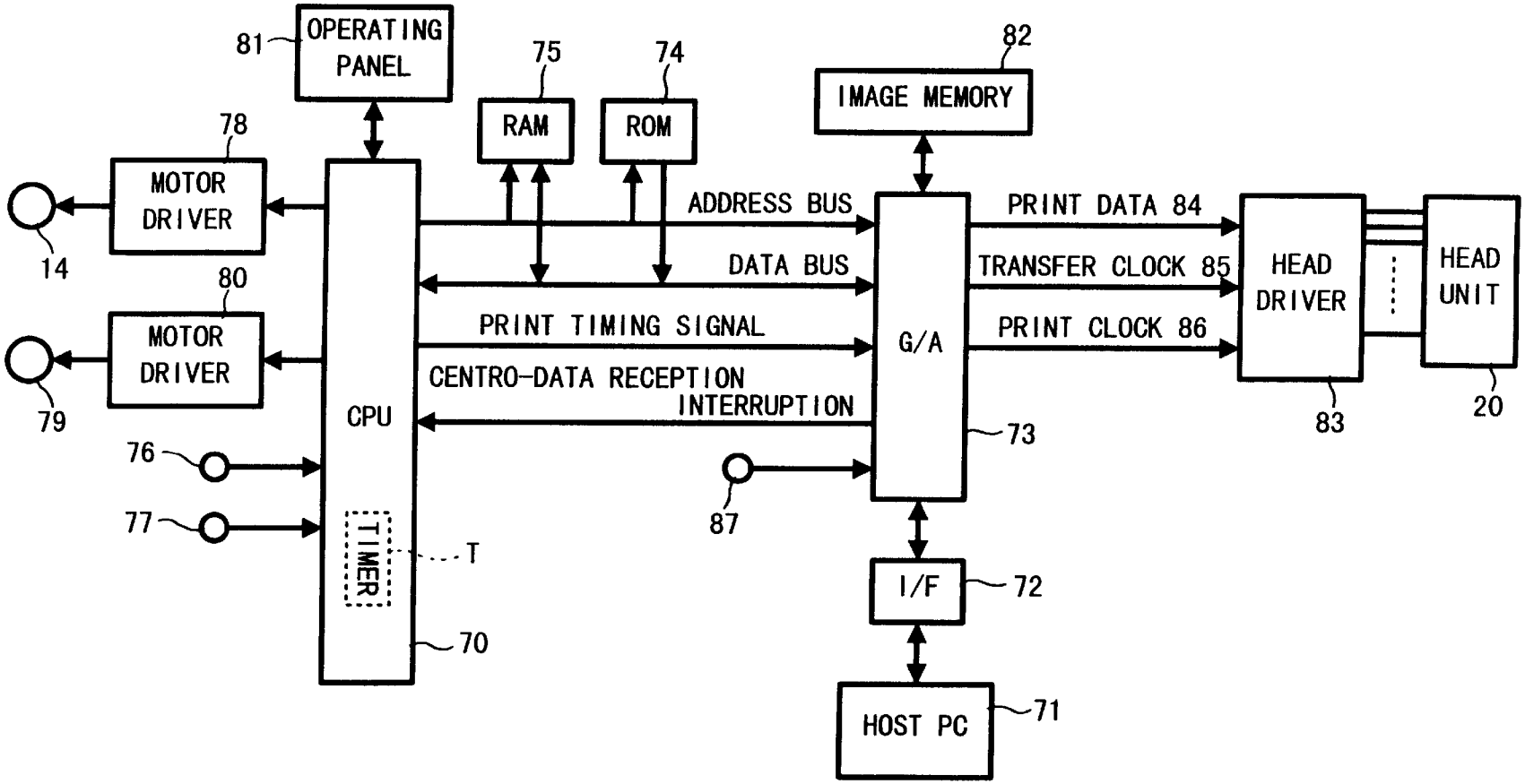
FIG. 2 is a block diagram of a control system of the ink jet printer shown in FIG. 1.

The construction of a main control system of the printer 10 will be described with reference to FIG. 2 and FIG. 3. FIG. 2 is a block diagram of a main portion of the control system of the printer 10. FIG. 3 illustrates a flushing table stored in a ROM of the printer 10.

Referring first to FIG. 2, the printer 10 has a CPU 70 for outputting a printing instruction and a flushing instruction to the print head unit 20, and outputting a purging instruction to the purge device 40, and controlling other devices described above, and a gate array 73 for receiving print data from a host computer 71, via an interface 72, and controlling development of the print data. Disposed between the CPU 70 and the gate array 73 are a ROM 74 for storing operating programs and the like, and a RAM 75 for temporarily storing the print data received from the host computer 71 by the gate array 73. Necessary data input-output is performed between the ROM 74, the RAM 75, the CPU 70 and the gate array 73.

The CPU 70 has a built-in timer T for measuring a length of time including the time between performance of flushing of the print head unit 20 and output of a printing instruction to the print head unit 20. The ROM 74 stores a flushing table 90 shown in FIG. 3.

The content of the flushing table 90 will be described. The flushing table 90 stores elapsed times including times between performance of previous flushing and output of a printing instruction, and the numbers of times of ejection to be performed by the individual heads 21–24, or sets of these heads for flushing. These data are arranged separately for the heads 21–24, or sets of these heads in correspondence to each other in the form of a table.

The numbers of times of ink ejection to be performed by the heads 21–24 in a case where the elapsed time between the previous flushing and output of a printing instruction is equal to or greater than 10 seconds but less than 30 minutes are: 10 times for the black ink head 21; and 0 time for the yellow ink head 22, the cyan ink head 23 and the magenta ink head 24. It should be noted that "the number of times of ink ejection" includes zero. When the elapsed time between the previous flushing and output of a printing instruction is less than 10 seconds, zero ink ejection is performed from all printing heads. If the elapsed time between the previous flushing and output of a printing instruction is equal to or greater than 30 minutes but less than an hour: 20 times for the black ink head 21; and 10 times for the yellow ink head 22, the cyan ink head 23 and the magenta ink head 24.

Since the yellow ink, the magenta ink and the cyan ink are slower to dry than the black ink, the ink ejecting performance of the nozzles of the yellow ink head 22, the cyan ink head 23 and the magenta ink head 24 can be recovered by performing ink ejection fewer times than is required for the nozzles of the black ink head 21. Therefore, the preset number of times of ink ejection for the three color ink heads 22–24 is less than the preset number of times of ink ejection for the black ink head 21.

Although the preferred mode of operation is to measure an elapsed time between the completion of preliminary ink ejection or flushing and the output of a printing instruction, the elapsed time could be measured starting from any point in time after a number of times of flushing has been read from the flushing table 90. The actual flushing of the print heads occurs between the time when a printing instruction is output to the print head and when printing in accordance with the printing instruction actually occurs. Therefore, the elapsed time used for determining the desired amount of flushing to be performed in a subsequent cycle can be measured from any time after a number of times of flushing has been read from the flushing table 90 for a preceding cycle and the output of the subsequent printing instruction.

The CPU 70 is connected with a sheet sensor 76 for detecting the presence/absence of a print sheet 11, a home position sensor 77 for detecting the print head unit 20 at the home position, a first motor driver 78 for driving the carriage motor 14, a second motor driver 80 for driving a line feed (LF) motor 79 for rotating the platen roller 12, an operating panel 81 for inputting various signals to the CPU 70, and the like. The gate array 73 is connected with an image memory 82 for temporarily storing print data from the host computer 71 as image data. A head driver 83 drives the print head unit 20 on the basis of the print data 84, a transfer clock 85 and a print clock 86 that are outputted from the gate array 73. The gate array 73 is also connected with an encoder sensor 87 for measuring the moving speed of the carriage 29 and determining a print timing.

Figure 4:
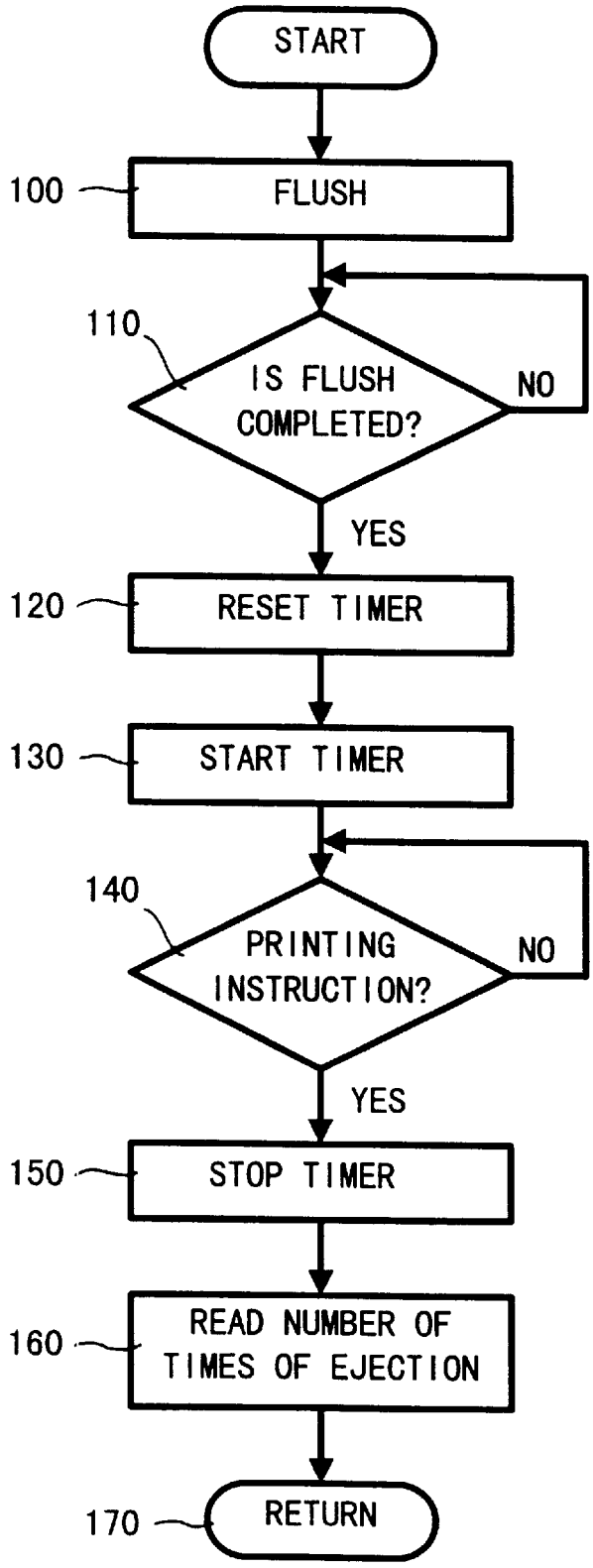
FIG. 4 is a flowchart illustrating the control of flushing performed by a CPU shown in FIG. 2.

The control performed by the CPU 70 for flushing will be described below with reference to the flowchart of FIG. 4.

After flushing is started in step 1, the CPU determines in step 110 whether the flushing is completed. When the flushing is completed, the timer T is reset in step 120, and started in step 130 to count time until a printing instruction is outputted. As described above, the timer could also be reset and started before flushing is completed and any time after reading the number of times of ink ejection from the flushing table 90. When print data from the host computer 71 is inputted to the gate array 73 via the interface 72, the CPU 70 outputs a printing instruction. The CPU determines in step 140 that a printing instruction has been outputted, and therefore stops the counting by the timer T in step 150.

Subsequently, the CPU 70 reads data indicating the number of times of ejection corresponding to the count value of the timer T, from the flushing table 90 stored in the ROM 74 in step 160.

For example, if the count value of the timer T indicates two hours, the CPU 70 reads data indicating 30 times of ejection for the black ink head 21 and data indicating 20 times of ejection for the yellow ink head 22, the cyan ink head 23 and the magenta ink head 24.

The CPU 70 then outputs a driving instruction to the carriage motor 14 to move the print head unit 20 to the flushing position and drives the individual color ink heads 21–24 for flushing (steps 170 and 100). If the count value of the timer T indicates two hours, the black ink head 21 ejects ink 30 times to the ink absorbing pad 30, and each of the yellow ink head 22, the cyan ink head 23 and the magenta ink head 24 ejects ink 20 times.

Since the extent of ink dryness is less in the nozzles of the yellow ink head 22, the cyan ink head 23 and the magenta ink head 24 than in the nozzles of the black ink head 21 if two hours has elapsed following the previous flushing, the three color ink heads 22–24 preliminarily eject ink fewer times than the black ink head 21. Thereby, unnecessary consumption of the three color inks for flushing can be reduced.

In this manner, the operation through steps 110–160 is repeated. In each operation cycle, step 160 reads data indicating the number of times of ejection corresponding to the count value of the timer T, from the flushing table 90, so that the individual color ink heads preliminarily eject inks the number of times indicated by the data read from the flushing table 90.

The timer T continues operating even if the power switch of the printer 10 is turned off, so that the timer T continues counting time elapsing after previous flushing.

As understood from the above description, the printer 10 of this embodiment performs greater numbers of times of ink ejection to the ink absorbing pad 30 for flushing for greater lengths of time elapsing between previous flushing and output of a printing instruction, thereby reducing unnecessary consumption of ink for flushing compared with the conventional art, wherein ink is ejected a fixed number of times regardless of lengths of time elapsing after previous flushing.

Furthermore, since the number of times of ink ejection for flushing varies depending on different color inks, that is, the different drying speeds of the inks, it becomes possible to further reduce unnecessary consumption of ink for flushing compared with the conventional art, wherein the number of times of ejection remains unchanged regardless of ink colors.

The same numbers of times of ejection are pre-set for the four color ink heads 21–24 for cases where the time elapsing after the previous flushing is three hours or longer in this embodiment, as shown in FIG. 3. This is because if no ink ejection has been performed for 3 hours or longer, all the inks have dried to a considerable extent regardless of the different ink colors, so that the same numbers of times of ejection for flushing as shown in FIG. 3 are substantially needed for any of the color inks to recover the ink ejecting function of the nozzles.

Although, in the foregoing embodiment, different numbers of times of ejection for flushing are pre-set for different ink colors, it is also possible to pre-set different numbers of times of ink ejection based on the drying speed, viscosity or other properties of inks if a printer uses a plurality of inks having the same color but different properties. Furthermore, since the ink drying speed also varies depending on ambient temperature, it is also possible to provide a construction wherein a temperature detecting device is provided for detecting ambient temperature before flushing and the number of times of ejection for flushing is changed depending on the detected ambient temperature. In such a construction, the flushing table 90 is designed based on parameters of ink colors, ambient temperature and the count value of the timer T. The numbers of times of ejection for flushing can also be pre-set for sets of printing heads that eject different ink colors. For example, the numbers of times of ink ejection can be pre-set to be a predetermined number for a set of printing heads including yellow, magenta and cyan.

Further, it is possible to form an ink jet printer according to the present invention by a data generating unit (namely, a host computer) and a printing unit (namely, an ordinary printer) connected to the host computer and allow a control device of the data generating unit, including a CPU, to perform the entire control according to the present invention or detect preliminary ejecting operation of the printing unit and measure elapsed time up to the next printing instruction. In this construction, programs for operating the data generating unit in the aforementioned manner can be provided in a storage medium readable by the host computer, such as a magnetic storage medium.

In the foregoing embodiment, steps 100–170 executed by the CPU 70 perform a function of preliminary ejection according to the present invention.

It is to be understood that the invention is not restricted to the particular forms shown in the foregoing embodiment. Various modifications and alternations can be made thereto without departing from the scope of the invention encompassed by the appended claims.

What is claimed is:

1. An ink jet printer, comprising:

a printing head unit for ejecting ink from an ink source through a nozzle to a recording medium upon receipt at the printing head unit of a printing instruction;

a waste ink receiving portion;

a preliminary ejection unit for performing preliminary ink ejection through the nozzle to said waste ink receiving portion to achieve a desirable ink ejecting condition of the printing head unit;

a timer for measuring elapsed time including time between a performance by said preliminary ejection unit of preliminary ink ejection and an output of a printing instruction to the printing head unit; and a controller for variably controlling an amount of ink to be preliminarily ejected by said preliminary ejection unit in accordance with an elapsed time measured by said timer.

2. The ink jet printer according to claim 1, wherein the printing head unit comprises a plurality of heads that eject inks having different properties, and wherein the timer measures elapsed times including time between a performance of preliminary ink ejection from each of sets of the plurality of heads to the waste ink receiving portion, and an output of a printing instruction to the printing head unit, and wherein the controller variably controls, separately for each of the sets of the plurality of heads, the amount of ink to be preliminarily ejected, corresponding to the elapsed times measured by the timer and a property of an ink to be ejected by each of the sets of the plurality of heads.

3. The ink jet printer according to claim 2, wherein the controller determines equal amounts of ink to be preliminarily ejected from each of the sets of the plurality of heads if the elapsed times measured by the timer for each of the sets of the plurality of heads are longer than a predetermined length of time.

4. The ink jet printer according to claim 1, wherein the timer continues measuring time elapsing after a performance of preliminary ink ejection even if the ink jet printer is turned off.

5. The ink jet printer according to claim 1, wherein the controller variably controls the amount of ink to be preliminarily ejected from the printing head unit to the waste ink receiving portion by controlling a number of times to perform ink ejection.

6. The ink jet printer according to claim 1, wherein the controller determines a first amount of the ink to be preliminarily ejected to the waste ink receiving portion, if the elapsed time measured by the timer is shorter than a predetermined length of time, and the controller determines a second amount of the ink to be preliminarily ejected, the second amount being larger than the first amount, if the elapsed time measured by the timer is longer than the predetermined length of time.

7. The ink jet printer according to claim 1, wherein said timer measures elapsed time between completion of said performance by said preliminary ejection unit of preliminary ink ejection and an output of a printing instruction to the printing head unit.

8. A recording medium for use with an ink jet printer having a printing head unit with a plurality of printing heads, said recording medium being encoded with a computer-readable control program causing said ink jet printer to:

preliminarily eject ink from said printing head unit of the printer to a waste ink receiving portion;

measure elapsed time including time from said preliminary ejection to an output of a printing instruction to the printing head unit; and variably control an amount of ink preliminarily ejected from said printing head unit in accordance with said measured elapsed time.

9. The recording medium according to claim 8, wherein said control program causes said ink jet printer to preliminarily eject ink from each of sets of said plurality of printing heads making up said printing head unit to said waste ink receiving portion, measure elapsed times including time between a performance of preliminary ink ejection from each of the sets of the plurality of heads to said waste ink receiving portion and an output of a printing instruction to said printing head unit, and variably control, separately for each of the sets of the plurality of heads the amount of ink to be preliminarily ejected, corresponding to the measured elapsed times and properties of inks to be ejected by each of the sets of the plurality of heads.

10. The recording medium according to claim 9, wherein said control program causes said ink jet printer to control amounts of ink to be preliminarily ejected by each of the sets of the plurality of heads by controlling a number of times each of the sets of the plurality of heads preliminarily ejects ink.

11. The recording medium according to claim 9, wherein said control program causes said ink jet printer to preliminarily eject equal amounts of ink from each of the sets of the plurality of heads if the measured elapsed times are longer than a predetermined length of time.

12. The recording medium according to claim 8, wherein said control program causes said inkjet printer to preliminarily eject a first amount of ink when said measured elapsed time is less than a predetermined length of time, and a second amount greater than the first amount if the measured elapsed time is greater than or equal to said predetermined length of time.

13. The recording medium according to claim 8, wherein said control program causes said ink jet printer to measure elapsed time between completion of said preliminary ink ejection and an output of a printing instruction to the printing head unit.

14. A method of operating an ink jet printer having a printing head unit, said printing head unit having a plurality of heads that eject inks having different properties, and a waste ink receiving portion, said method comprising:

preliminarily ejecting ink from said printing head unit to said waste ink receiving portion;

measuring an elapsed time including time from completion of said preliminary ejection step to an output of a printing instruction to said printing head unit;

subsequently preliminarily ejecting ink from said printing head unit to said waste ink receiving portion upon a detection of said output of a printing instruction to said printing head unit while controlling an amount of ink being preliminarily ejected to correspond with the elapsed time measured during said measuring step.

15. The method according to claim 14, wherein said step for measuring an elapsed time includes measuring an elapsed time between completion of preliminary ink ejection from each of sets of said plurality of heads and an output of a printing instruction to said printing head unit, and said step for subsequently preliminarily ejecting ink from said printing head unit includes controlling an amount of ink being preliminarily ejected from each of said sets of the plurality of heads to correspond with the respective measured elapsed time for each of said sets of the plurality of heads and a property of an ink being ejected from each of the sets of the plurality of heads.

16. The method according to claim 15, wherein said step for subsequently preliminarily ejecting ink from said printing head unit includes controlling an amount of ink being preliminarily ejected from each of said sets of the plurality of heads to be equal when the respective measured elapsed time for each of said sets of the plurality of heads is longer than a predetermined length of time.

17. The method according to claim 14, wherein said step for measuring an elapsed time continues even if power is cut off to the ink jet printer.

18. The method according to claim 14, wherein said controlling of an amount of ink being preliminarily ejected is performed by controlling a number of times ink is ejected.

19. The method according to claim 14, wherein said step for subsequently preliminarily ejecting ink includes preliminarily ejecting a first amount of ink when the measured elapsed time is less than a predetermined length of time, and a second amount of ink greater than the first amount if the measured elapsed time is greater than or equal to said predetermined length of time.

20. The method according to claim 14, wherein said elapsed time is measured from said completion of said preliminary ejection step to said output of a printing instruction to said printing head unit.

* * * * *